United States Patent [19]

Nate et al.

[11] Patent Number: 4,865,660

[45] Date of Patent: Sep. 12, 1989

[54] RARE-EARTH ELEMENT/COBALT TYPE MAGNET POWDER FOR RESIN MAGNETS

[75] Inventors: Tatsuo Nate; Koichi Oka, both of Ichikawa; Takehiko Satoh, Musashino, all of Japan

[73] Assignee: Sumitomo Metal Mining Company Ltd., Tokyo, Japan

[21] Appl. No.: 219,856

[22] Filed: Jul. 13, 1988

Related U.S. Application Data

[63] Continuation of Ser. No. 834,419, Feb. 28, 1986, abandoned.

[30] Foreign Application Priority Data

| | | | |
|---|---|---|---|
| Feb. 28, 1985 | [JP] | Japan | 60-37702 |
| Feb. 28, 1985 | [JP] | Japan | 60-37703 |
| Mar. 7, 1985 | [JP] | Japan | 60-43816 |
| Mar. 7, 1985 | [JP] | Japan | 60-43817 |

[51] Int. Cl.[4] ..... H01F 1/04

[52] U.S. Cl. ..... 148/301; 148/104

[58] Field of Search ..... 148/301

[56] References Cited

U.S. PATENT DOCUMENTS

| | | | |
|---|---|---|---|
| 3,682,714 | 8/1972 | Martin | 148/301 |
| 3,933,536 | 1/1976 | Doser | 148/301 |
| 3,985,588 | 10/1976 | Lyman | 148/301 |
| 4,003,767 | 1/1977 | Bachmann et al. | 148/105 |
| 4,090,892 | 5/1978 | Klein et al. | 148/103 |
| 4,144,105 | 3/1979 | Gaiffi et al. | 148/103 |

*Primary Examiner*—John P. Sheehan

*Attorney, Agent, or Firm*—Watson, Cole, Grindle & Watson

[57] ABSTRACT

Magnetic powder of the samarium/praseodymium/-cobalt type and of the samarium/praseodymium/-neodymium/cobalt type having specific compositions is substantially composed of (1–5) single phase, has improved residual magnetic flux density and a high maximum energy product, and is hence suitable for resin magnets. In addition, production cost is lower compared with conventional rare-earth metal/cobalt type magnet powder because part of samarium metal has been replaced by praseodymium and neodymium which are more abundant and less expensive materials.

2 Claims, No Drawings

RARE-EARTH ELEMENT/COBALT TYPE MAGNET POWDER FOR RESIN MAGNETS

This application is a continuation of application Ser. No. 834,419 filed Feb. 28, 1986 now abandoned.

BACKGROUND OF THE INVENTION

1. Field of the Invention

This invention relates to a rare-earth element/cobalt-type magnet powder for resin magnets having a specific composition, that is, a samarium(Sm)/cobalt(Co)-type magnet powder that includes praseodymium(Pr) and neodymium(Nd) added in.

2. Description of the Prior Art

Rare-earth element/cobalt type magnet powders (hereinafter referred to simply as "magnet powder"), particularly samarium/cobalt-type magnet powders, have been used, in combination with resins such as polyamide, for the manufacture of resinous magnets which are employed in various types of motors, electrical appliances, computer terminal equipment and many other products.

Two methods are known for commercial production of magnet powder: the melt process, in which component metals are melted in a high-frequency furnace or in an arc furnace, then the molten alloy is cast into a mold to form ingots, and finally by pulverization; and the reduction-diffusion process, in which a mixture of rare-earth metal oxides, a reducing agent, such as calcium metal, and cobalt powder are placed in a vessel and heated to a temperature in the range of 900° to 1100° C. under normal pressure in an inert gas atmosphere, then reaction product is put into water to form a slurry, and then the slurry is treated with water and a dilute acid.

The magnet powder obtained by the melt process has low residual mangnetic flux density, although high in coercive force. On the other hand, the reaction products of the reduction-diffusion process have (1–5) phase composition on average (actually multi-phases). Hence, the magnet powder obtained by this process, for use as a sintered magnet, is heat-treated, after being press-formed, to enhance its magnetic characteristics. Since such heat-treatment cannot be performed after the magnet powder is kneaded with a resin, the resultant resin magnet shows far poorer magnetic characteristics, particularly in residual magnetic flux density.

SUMMARY OF THE INVENTION

We have found that conventional magnet powder for resin magnets has (1–5) phase composition on average, that is, it also contains, other than (1–5) phase, (1–3), (2–7), (2–17) and other intermetallic compounds, which adversely affect the magnetic characteristics of the total system. Thus the object of this invention is to provide magnet powder for resin magnets with improved residual magnetic flux density and with a high maximum energy product.

It was discovered that this object can be achieved by using Sm-Pr-Co type or Sm-Pr-Nd-Co type magnet powder with a specific composition, which is substantially composed of (1–5) single phase. This invention was accomplished based on these findings. The first aspect of this invention relates to magnet powder whose composition is represented by $Sm_{1-x}Pr_xCo_z$ (wherein $0.05 \leqq x \leqq 0.4$ and $4.7 \leqq z \leqq 5.3$) and substantially composed of (1–5) single phase, and the second aspect of this invention is concerned with magnet powder whose composition is represented by $Sm_{1-x}Pr_{x-y}Nd_yCo_z$ (wherein $0.05 \leqq x \leqq 0.4$, $0.01 \leqq y \leqq 0.39$, $0.01 \leqq x-y \leqq 0.39$ and $4.7 \leqq z \leqq 5.3$) and substantially composed of 1–5 single phase.

DETAILED DESCRIPTION OF THE INVENTION

As stated above, the magnet powder of the first aspect of this invention has a composition represented by $Sm_{1-x}Pr_xCo_z$ (wherein $0.05 \leqq x \leqq 0.4$ and $4.7 \leqq z \leqq 5.3$). This range of composition was determined based on the following test experiment.

Mixtures of component metals (proportions listed in Table 1) were melted in a high-frequency furnace, and the molten alloy was cast into a mold. The ingot thus obtained was maintained at 620° C. for two hours in an argon gas atmosphere, quenched, then crushed until all the materials passed through a 3.5 mesh sieve, and finally ground in a ball mill filled with ethanol for five hours, affording magnet powder having an average particle size of 3 to 10 μm.

Separately, mixtures of rare-earth metal oxides, Co powders and granules of calcium metal (proportions listed in Table 1) were heated in an electric furnace controlled at 1100° C. for three hours in an argon gas atmosphere, and each treated mixture was allowed to cool to 900° C. and quenched with water. The reaction product was then treated with water and then with dilute acetic acid (pH: about 2.5) to remove contained CAO and unreacted calcium metal, and the magnet powder thus obtained was collected by filtration, washed with ethanol to displace the water left attached, dried, and ground in a ball mill giving magnet powder having an average particle size of 3 to 10 μm.

Each magnet powder, obtained in the above two series of experiments, was mixed with an epoxy resin in the amount of 5% by weight of an outer percentage, the mixture was compression-molded under a pressure of 4 t/cm$^2$ in a magnetic field of 13 KOe, and the molded product was held in an oven controlled at 120° C. for two hours to cure the epoxy resin. The resin magnets thus prepared were measured for magnetic characteristics, such as residual magnetic flux density Br (KG), coercive force$_B$Hc (KOe) and maximum energy product $(BH)_{max}$ (MGOe) by means of a DC magnetic flux meter. The result is summarized in Table 2.

It is apparent from the table that, when x is less than 0.05, the enhancement of residual magnetic flux density due to addition of praseodymium is insufficient, while a sharp drop in coercive force takes place when x exceeds 0.4. When z is less than 4.7, residual magnetic flux density tends to be lower because of the formation of heterogeneous phases, (1–3) and (2–7). When z exceeds 5.3, on the other hand, heterogeneous phase, (2–17), tends to be formed, with the consequent reduction in coercive force.

TABLE 1

| Test | Composition (wt %) | | | Composition ($Sm_{1-x}Pr_xCo_z$) | |
|---|---|---|---|---|---|
| No. | Sm | Pr | Co | x | z |
| Melt Process | | | | | |
| 1 | 33.6 | 0.0 | 66.0 | 0.00 | 5.02 |
| 2 | 30.6 | 3.2 | 65.9 | 0.10 | 4.95 |
| 3 | 20.4 | 12.7 | 66.8 | 0.40 | 5.01 |
| 4 | 10.6 | 22.8 | 65.8 | 0.70 | 4.82 |
| 5 | 26.1 | 4.7 | 69.2 | 0.16 | 5.68 |
| Reductive Diffusion Process | | | | | |
| 6 | 33.8 | 0.0 | 66.2 | 0.00 | 5.00 |
| 7 | 23.8 | 9.6 | 66.6 | 0.30 | 5.00 |

TABLE 1-continued

| Test No. | Composition (wt %) Sm | Pr | Co | Composition ($Sm_{1-x}Pr_xCo_z$) x | z |
|---|---|---|---|---|---|
| 8 | 20.4 | 12.7 | 66.7 | 0.40 | 4.99 |
| 9 | 10.3 | 22.5 | 67.2 | 0.70 | 5.00 |
| 10 | 30.5 | 1.5 | 68.0 | 0.05 | 5.41 |

TABLE 2

| Test No. | bHc (KOe) | Br (KG) | $(BH)_{max}$ (MGOe) |
|---|---|---|---|
| Melt Process | | | |
| 1 | 5.50 | 6.50 | 10.00 |
| 2 | 5.30 | 7.35 | 11.00 |
| 3 | 5.10 | 7.45 | 10.30 |
| 4 | 2.50 | 7.50 | 7.15 |
| 5 | 2.05 | 3.80 | 2.45 |
| Reductive-Diffusion Process | | | |
| 6 | 5.95 | 6.50 | 10.05 |
| 7 | 5.25 | 7.55 | 11.50 |
| 8 | 5.20 | 7.50 | 10.85 |
| 9 | 2.30 | 7.45 | 7.15 |
| 10 | 1.95 | 3.05 | 2.50 |

The magnet powder of the second aspect of this invention has a composition represented by $Sm_{1-x}Pr_{x-y}Nd_yCo_z$ (wherein $0.05 \leqq x \leqq 0.4$, $0.01 \leqq y \leqq 0.39$, $0.01 \leqq x-y \leqq 0.39$, $4.7Z \leqq 5.3$). This range of composition was also determined in the same manner as in the case with the first aspect of this invention. Mixtures of component materials (proportions listed in Table 3) were treated by the melt process and by the reduction-diffusion process to give magnet powder, from which resin magnets were produced in a similar way. Magnetic characteristics of these resin magnets are summarized in Table 4.

It is apparent from the table that, when x is less than 0.05, the enhancement of residual magnetic flux density due to addition of praseodymium and neodymium is insufficient, and that coercive force tends to lower when x exceeds 0.40, when y becomes below 0.01, when y exceeds 0.39, when (x−y) becomes less than 0.01, or when (x−y) exceeds 0.39. When z is less than 4.7, residual magnetic flux density tends to be lower because of the formation of heterogeneous phases, (1–3) and (2–7). When z exceeds 5.3, on the other hand, heterogeneous phase, (2–17), tends to be formed, with the consequent reduction in coercive force.

TABLE 3

| Test No. | Composition (wt %) Sm | Pr | Nd | Co | Composition ($Sm_{1-x}Pr_{x-y}Nd_yCo_z$) x | y | x − y | z |
|---|---|---|---|---|---|---|---|---|
| Melt Process | | | | | | | | |
| 1 | 30.5 | 2.6 | 0.6 | 66.3 | 0.10 | 0.02 | 0.08 | 4.99 |
| 2 | 30.5 | 1.9 | 1.3 | 66.3 | 0.10 | 0.04 | 0.06 | 5.00 |
| 3 | 30.4 | 0.6 | 2.7 | 66.3 | 0.10 | 0.08 | 0.02 | 5.00 |
| 4 | 32.1 | 2.0 | 1.4 | 64.4 | 0.10 | 0.04 | 0.06 | 4.60 |
| 5 | 28.4 | 1.2 | 1.8 | 68.6 | 0.10 | 0.06 | 0.04 | 5.55 |
| 6 | 23.5 | 7.6 | 1.7 | 67.2 | 0.30 | 0.05 | 0.24 | 5.14 |
| 7 | 23.6 | 6.4 | 3.2 | 66.8 | 0.30 | 0.10 | 0.20 | 5.05 |
| 8 | 23.5 | 3.2 | 6.5 | 66.8 | 0.30 | 0.20 | 0.10 | 5.06 |
| 9 | 25.4 | 6.2 | 4.1 | 64.3 | 0.30 | 0.12 | 0.18 | 4.53 |
| 10 | 22.4 | 4.5 | 4.6 | 68.5 | 0.30 | 0.15 | 0.15 | 5.46 |
| 11 | 17.0 | 6.4 | 9.8 | 66.8 | 0.50 | 0.30 | 0.20 | 5.01 |
| 12 | 17.0 | 12.7 | 3.2 | 67.0 | 0.50 | 0.10 | 0.40 | 5.03 |
| Reductive-Diffusion Process | | | | | | | | |
| 13 | 30.6 | 2.6 | 0.6 | 66.1 | 0.10 | 0.02 | 0.08 | 4.96 |
| 14 | 30.1 | 1.9 | 1.3 | 66.7 | 0.10 | 0.04 | 0.06 | 5.10 |
| 15 | 30.5 | 0.6 | 2.6 | 66.3 | 0.10 | 0.08 | 0.02 | 5.00 |
| 16 | 32.9 | 2.0 | 1.4 | 63.7 | 0.10 | 0.04 | 0.06 | 4.45 |
| 17 | 28.2 | 1.7 | 1.2 | 68.8 | 0.10 | 0.04 | 0.06 | 5.60 |

TABLE 3-continued

| Test No. | Composition (wt %) Sm | Pr | Nd | Co | Composition ($Sm_{1-x}Pr_{x-y}Nd_yCo_z$) x | y | x − y | z |
|---|---|---|---|---|---|---|---|---|
| 18 | 23.7 | 7.9 | 1.6 | 66.7 | 0.30 | 0.05 | 0.25 | 5.01 |
| 19 | 24.1 | 6.4 | 3.3 | 66.1 | 0.30 | 0.10 | 0.20 | 4.90 |
| 20 | 23.4 | 3.1 | 6.4 | 67.1 | 0.30 | 0.20 | 0.10 | 5.12 |
| 21 | 25.4 | 6.1 | 4.1 | 64.4 | 0.30 | 0.12 | 0.18 | 4.56 |
| 22 | 22.5 | 4.5 | 4.6 | 68.4 | 0.30 | 0.15 | 0.15 | 5.43 |
| 23 | 17.0 | 9.5 | 6.5 | 66.9 | 0.50 | 0.20 | 0.30 | 5.03 |
| 24 | 17.0 | 3.2 | 13.0 | 66.8 | 0.50 | 0.40 | 0.10 | 5.01 |

TABLE 4

| Test No. | BHc (KOe) | Br (KG) | $(BH)_{max}$ (MGOe) |
|---|---|---|---|
| Melt Process | | | |
| 1 | 4.90 | 6.75 | 11.25 |
| 2 | 5.10 | 6.70 | 11.25 |
| 3 | 5.15 | 6.75 | 11.40 |
| 4 | 1.80 | 3.05 | 2.45 |
| 5 | 1.90 | 3.00 | 2.50 |
| 6 | 4.25 | 6.65 | 11.20 |
| 7 | 4.55 | 6.65 | 11.30 |
| 8 | 5.05 | 6.65 | 11.50 |
| 9 | 1.85 | 3.00 | 2.90 |
| 10 | 1.65 | 3.10 | 2.75 |
| 11 | 4.55 | 6.50 | 9.85 |
| 12 | 4.55 | 6.60 | 9.90 |
| Reductive-Diffusion Process | | | |
| 13 | 5.75 | 7.40 | 11.55 |
| 14 | 5.80 | 7.40 | 11.75 |
| 15 | 5.90 | 7.40 | 12.00 |
| 16 | 1.80 | 3.05 | 2.45 |
| 17 | 1.75 | 3.00 | 2.40 |
| 18 | 5.55 | 7.50 | 11.60 |
| 19 | 5.70 | 7.45 | 11.65 |
| 20 | 5.80 | 7.55 | 12.05 |
| 21 | 1.80 | 2.95 | 2.90 |
| 22 | 1.65 | 3.10 | 2.75 |
| 23 | 5.30 | 7.45 | 9.95 |
| 24 | 5.25 | 7.45 | 9.90 |

The magnet powder having the compositions specified above can be produced by using respective component metals or oxides thereof. Praseodymium and neodymium may be added separately to samarium metal, cobalt metal and samarium oxide, or materials containing these metals may be used in proportions that will give the specified composition.

The magnet powder of this invention may be produced by the melt process or by the reduction-diffusion process. In the melt process, component metals are mixed in a desired proportion within the range specified above, the mixture is melted in a high-frequency furnace or an arc furnace, the molten alloy is cast into a mold, the ingot of samarium-praseodymium-cobalt alloy or of samarium-praseodymium-neodymium-cobalt alloy thus prepared is maintained at a temperature in the range from 600° to 900° C. over a period from 30 minutes to five hours, and the treated ingot is quenched and pulverized. When the reduction-diffusion process is adopted, rare-earth metal oxides and cobalt powder are mixed in a desired proportion within the range specified above, a reducing agent such as calcium metal is added, the resulting mixture is heated in a vessel under normal pressure in an inert gas (e.g., argon gas) atmosphere to ensure diffusion of Samarium and praseodymium (and neodymium, as required) in cobalt powder. The reaction product is then heat-treated in the same way as in the melt process, and the heat-treated product is put into water to form a slurry, followed by treatment with water and a dilute acid (e.g., dilute acetic acid) to remove the calcium component.

The heat-treated ingot or heat-treated powder thus obtained is then ground into magnet powder having an average particle size in the range from 3 to 10 μm. If the average particle size is smaller than 3 μm, residual magnetic flux density will be too low. If the particle size exceeds 10 μm, on the other hand, coercive force will be too low.

If the heat treatment temperature is lower than 600° C., the intended effect (to ensure (1–5) single phase and to removal thermal stress, thereby achieving consistent coersive force) is insufficient. If the heat treatment temperature is higher than 900° C., on the other hand, the composition of resulting magnet powder tends to be out of the range specified above and phases other than (1–5) are likely to be formed. The heating time should preferably be in the range from 30 minutes to five hours. The cooling after heat treatment should preferably be performed at a rate of 10° C./min or higher, as otherwise phases other than (1–5) phase are likely to be formed.

Resin magnets can be produced in usual way from the magnet powder obtained above by kneading it with a thermoplastic resin, such as polyamides (e.g., nylon 6, nylon 12, nylon 66 and nylon 610), polycarbonates, acrylonitrile/butadiene/styrene copolymers, polyphenylenesulfides and polyether-ether-ketone resins, or with a thermosetting resin, such as epoxy resins, phenolic resins, amino resins and unsaturated polyester resins.

As may be apparent from the foregoing, the magnet powder of this invention is of the rare-earth metal/-cobalt type having a specific composition, which is substantially composed of (1–5) single phase, has improved residual magnetic flux density and a high maximum energy product, and is hence suitable for resin magnets.

Another advantage is the lower cost because part of the samarium metal in conventional rare-earth metal/-coblat type magnet powder has been replaced by praseodymium and neodymium which are more abundant and less expensive materials.

The following Examples will further illustrate this invention.

EXAMPLE 1

A mixture of 24.4 weight % of samarium metal, 9.7% of praseodymium metal and 65.9% of cobalt metal was melted in a high-frequency furnace, and the molten alloy was cast into a mold. The ingot thus obtained was maintained at 620° C. for two hours in an argon gas atmosphere, quenched at a rate of 30° C./min, and ground in a ball mill to an average particle size in the range from 3 to 10 μm, affording magnet powder having the composition shown in Table 5.

This magnet powder was kneaded with an epoxy resin in the amount of 5% by weight of an outer percentage, the mixture was compression-molded under a pressure of 4 t/cm$^2$ in a magnetic field of 13 KOe, and the molded product was heated for two hours in an oven controlled at 120° C. Magnetic characteristics of the resin magnet thus obtained were measured by the method described above. The result is shown in Table 6. X-ray diffraction analysis revealed that this magnet powder is composed of (1–5) single phase.

EXAMPLE 2

A mixture of 30.5 weight % (as Sm) of $Sm_2O_3$ powder, 3.3% (as Pr) of $Pr_6O_{11}$, 66.2% of Co powder and granules of calcium metal placed in a vessel was heated in an electric furnace controlled at 1100° C. for three hours in an argon gas atmosphere, the temperature in the furnace was allowed to lower to 800° C. over a period of one hour, maintained at 800° C. for two hours, and the reaction product was quenched at a rate of 30° C./min by blowing argon gas. The heat-treated product thus obtained was then treated with water and dilutle acetic acid (pH: approximately 2.5) to remove contained CaO and unreacted calcium metal. The powder formed was collected by filtration, washed with ethanol to displace water and dried, followed by pulverization in a ball mill to an average particle size of 3 to 10 μm, giving magnetic powder having the composition shown in Table 5.

A resin magnet was prepared using this magnet powder in the same manner as in Example 1, and its magentic characteristics were measured in a similar way. The result is summarized in Table 6. X-ray diffraction analysis revealed that this magnet powder is composed of (1–5) single phase.

EXAMPLE 3

A mixture of 30.3 weight % of samarium metal, 1.2% of praseodymium metal, 1.9% of neodymium metal and 66.6% of cobalt metal was treated in the same manner as in Example 1 to prepare a resin magnet, and its magnetic characteristics were measured in a similar way. The composition of the magnet powder and magnetic characteristics of the resin magnet are shown in Table 5 and Table 6, respectively. X-ray diffraction analysis revealed that this magnet powder is composed of (1–5) single phase.

EXAMPLE 4

A mixture of 30.8 weight % (as Sm) of $Sm_2O_3$ powder 1.3% (as Pr) of $Pr_6O_{11}$, 2.0% (as Nd) of $Nd_2O_3$ powder, 65.9% of Co powder and granules of calcium metal was treated in the same manner as in Example 2 to produce magnet powder, a resin magnet was prepared from this magnet powder in the same manner as in Example 1, and its magnetic characteristics were measured. The composition of the magnet powder and magnetic characteristics of the resin magnet are shown in Table 5 and Table 6, respectively. X-ray diffraction analysis revealed that this magnet powder is composed of (1–5) single phase.

Comparative Example 1

A mixture of 33.6 weight % of samarium metal and 66.0% of Co powder was treated in the same manner as in Example 1 to produce magnet powder, a resin magnet was prepared from this magnet powder in the same manner as in Example 1, and its magnetic characteristics were measured. The composition of the magnet powder and magnetic characteristics of the resin magnet are shown in Table 5 and Table 6, respectively. X-ray diffraction analysis revealed the presence of heterogeneous phases, (2–17) other than (1–5).

Comparative Example 2

A mixture of 33.8 weight % (as Sm) of $Sm_2O_3$ and 66.2% of Co powder was treated in the same manner as in Example 2 to produce magnet powder, a resin magnet was prepared from this magnet powder in the same manner as in Example 1, and its magnetic characteristics were measured. The composition of the magnet powder and magnetic characteristics of the resin magnet are shown in Table 5 and Table 6, respectively. X-ray diffraction analysis revealed the presence of heterogeneous phases, (2–7) and (2–17) other than (1–5).

Comparative Examples 3 through 8

Magnet powder was similarly prepared as in Examples 1 through 4 and in Comparative Examples 1 and 2, except that the alloy ingots or the reaction products were not subjected to heat treatment. Resin magnets were made from these magnet powder, and the magnetic characteristics were measured. The composition of the magnet powder and magnetic characteristics of the resin magnet are shown in Table 5 and Table 6, respectively. X-ray diffraction analysis revealed the presence of heterogeneous phases, (1–3) and (2–7), in Comparative Examples 3 and 6, (2–17) in Comparative Examples 5 and 7, and (2–7) and (2–17) in Comparative Examples 4 and 8, other than (1–5).

TABLE 5

| | Weight % | | | | $Sm_{1-x}Pr_xCo_z$ or $Sm_{1-x}Pr_{x-y}Nd_yCo_z$ | | | |
|---|---|---|---|---|---|---|---|---|
| Composition | Sm | Pr | Nd | Co | x | y | x − y | z |
| Example | | | | | | | | |
| 1 | 24.4 | 9.7 | — | 65.9 | 0.30 | — | — | 4.84 |
| 2 | 30.5 | 3.3 | — | 66.2 | 0.10 | — | — | 4.99 |
| 3 | 30.3 | 1.2 | 1.9 | 66.6 | 0.10 | 0.06 | 0.04 | 5.07 |
| 4 | 30.8 | 1.3 | 2.0 | 65.9 | 0.10 | 0.06 | 0.04 | 4.92 |
| Comp. Ex. | | | | | | | | |
| 1 | 33.6 | — | — | 66.0 | 0.00 | — | — | 5.02 |
| 2 | 33.8 | — | — | 66.2 | 0.00 | — | — | 5.00 |
| 3 | 24.4 | 9.7 | — | 65.9 | 0.30 | — | — | 4.84 |
| 4 | 30.5 | 3.3 | — | 66.2 | 0.10 | — | — | 4.99 |
| 5 | 30.3 | 1.2 | 1.9 | 66.6 | 0.10 | 0.06 | 0.04 | 5.07 |
| 6 | 30.8 | 1.3 | 2.0 | 65.9 | 0.10 | 0.06 | 0.04 | 4.91 |
| 7 | 33.6 | — | — | 66.0 | 0.00 | — | — | 5.02 |
| 8 | 33.7 | — | — | 66.2 | 0.00 | — | — | 5.01 |

TABLE 6

| Magnetic Characteristics | BHc (KOe) | Br (KG) | $(BH)_{max}$ (MGOe) |
|---|---|---|---|
| Example | | | |
| 1 | 5.25 | 7.45 | 11.05 |
| 2 | 5.45 | 7.50 | 11.60 |
| 3 | 5.25 | 6.80 | 11.45 |
| 4 | 5.85 | 7.45 | 12.05 |
| Comp. Ex. | | | |
| 1 | 5.50 | 6.50 | 10.00 |
| 2 | 5.95 | 6.50 | 10.05 |
| 3 | 5.05 | 6.85 | 10.50 |
| 4 | 5.25 | 7.30 | 11.05 |
| 5 | 5.10 | 6.35 | 10.95 |
| 6 | 5.30 | 7.40 | 11.45 |
| 7 | 5.25 | 6.10 | 9.75 |
| 8 | 5.30 | 6.55 | 10.00 |

What is claimed is:

1. A resin magnet which has a coercive force of at least 5.10 $KO_e$, a residual magnetic flux density of at least 7.35 KG and a maximum energy product of at least 10.30 $MGO_e$, said resin magnet consisting of a compression molded and heat-treated mixture of a rare earth element/cobalt magnet powder and a resin, said rare-earth element cobalt magnet powder, prior to mixing with said resin, being composed of $Sm_{1-x}Pr_xCo_z$, wherein $0.05 \leqq x \leqq 0.4$ and $4.7 \leqq z \leqq 5.3$ and a single phase, the average particle size of the magnet powder being 3 to 10 μm.

2. A resin magnet which has a coercive force of at least 4.90 $KO_e$, a residual magnetic flux density of at least 6.65 KG, and a maximum energy product of at least 11.20 $MGO_e$, said resin magnet consisting of a compression molded and heat-treated mixture of a rare earth element/cobalt magnet powder and a resin, said rare-earth element cobalt magnet powder, prior to mixing with said resin, being composed of $Sm_{1-x}Pr_{x-y}Nd_yCo_z$, wherein $0.05 \leqq x \leqq 0.4$, $0.01 \leqq y \leqq 0.39$, $0.01 \leqq x-y \leqq 0.39$ and $4.7 \leqq z \leqq 5.3$ and of a single phase, and the average particle size of the magnet powder being 3 to 10 μm.

* * * * *